US005395489A

United States Patent [19]

Ward et al.

[11] Patent Number: 5,395,489

[45] Date of Patent: Mar. 7, 1995

[54] ELECTROCHEMICALLY ROUGHENING ALUMINUM METAL SHEET

[75] Inventors: John A. Ward, Warwick; John A. Hunter, Nr. Banbury; Jonathan Ball, Deddington, all of United Kingdom; Peter K. F. Limbach, Gottingen, Germany

[73] Assignee: Alcan International Limited, Quebec

[21] Appl. No.: 157,112

[22] PCT Filed: Jun. 16, 1992

[86] PCT No.: PCT/EP92/01367

§ 371 Date: Jan. 21, 1994

§ 102(e) Date: Jan. 21, 1994

[87] PCT Pub. No.: WO92/22688

PCT Pub. Date: Dec. 23, 1992

[30] Foreign Application Priority Data

Jun. 19, 1991 [GB] United Kingdom ..... 9113214

[51] Int. Cl.[6] ..... C25F 3/04

[52] U.S. Cl. ..... 204/129.4; 204/129.75

[58] Field of Search ..... 204/129.4, 129.43, 129.75

[56] References Cited

U.S. PATENT DOCUMENTS

| | | | |
|---|---|---|---|
| 4,272,342 | 6/1981 | Oda et al. | 204/129.4 |
| 4,547,274 | 10/1985 | Ohashi et al. | 204/129.4 |
| 4,566,959 | 1/1986 | Mohr | 204/129.75 |
| 4,566,960 | 1/1986 | Mohr | 204/129.75 |
| 5,076,899 | 12/1991 | Sakaki et al. | 204/129.4 X |
| 5,114,825 | 5/1992 | Takizawa et al. | 204/129.4 X |

FOREIGN PATENT DOCUMENTS

| | | |
|---|---|---|
| 0096347 | 12/1983 | European Pat. Off. . |
| 1374787 | 11/1974 | United Kingdom . |

*Primary Examiner*—Donald R. Valentine

*Attorney, Agent, or Firm*—Cooper & Dunham

[57] ABSTRACT

A method of electrochemically roughening an aluminum metal sheet for use as a lithographic plate support comprises subjecting the sheet in an electrolyte to an alternating current treatment. Treatment is performed in the presence of at least one added component, present in the sheet or in the electrolyte, selected from Hg, Ga, In, Sn, Bi, Tl, Cd, Pb, Zn and Sb. The added component accelerates the electrograining, so that only 35–75 kCoulombs per square meter of electricity is required.

6 Claims, No Drawings

ELECTROCHEMICALLY ROUGHENING ALUMINUM METAL SHEET

This invention relates to a method of electrochemically roughening an Al sheet for use as a lithographic plate support.

To make an aluminium sheet suitable for use as a lithographic plate support, the surface needs to be roughened or grained. Standard techniques for this include: mechanical graining by the use of balls or abrasives or wire brushes; electrochemical graining, by the application of an AC current in an acidic electrolyte; and chemical graining, by simple immersion in an etch. Roughening is carried out in order to enhance the adhesion of a photosensitive coating on the support, and to improve the water retention properties of the uncoated support surface. Irradiation and development of a lithographic plate generally results in ink-receptive image areas and water-retaining non-image areas, the latter generally being the uncovered support surface. For this purpose the aluminium sheet needs to be roughened on a scale of approximately 1–15 μm, and to have an average roughness $R_a$ (measured by an optical technique) in the range 0.5–2.5 μm.

In the economics of this industry, time considerations are of paramount importance. In commercial electrochemical graining, sheet is passed continuously through a long bath of electrolyte, treatment time determines the speed of passage of the sheet, and the length of the bath and hence the amount of electrolyte used. Chemical etching is necessarily a relatively slow process, and is not envisaged here. This invention is an improvement in the electrochemical roughening process, based on the inventors discovery that added components, preferably in the Al sheet or alternatively in the electrolyte, permit treatment time to be reduced.

European patent application 96347A (Fuji) describes aluminium alloy sheets for use as lithographic printing plate supports, which sheets contain 0.005–0.01% of Sn, In, Ga or Zn, together with Fe and optionally Cu or Mg. These sheets are subjected to a chemical etch, optionally followed by an electrochemical treatment, and the added components improve the rate of chemical etching and produce a desired pitting structure on the metal sheet surface. There is no teaching to treat electrochemically a sheet which has not previously been subjected to a chemical etch.

British Patent Specification 1 374 787 (Kalle) mentions that the hydrochloric acid electrolyte, used to electrochemically roughen metal foil for lithographic printing plates, may contain mercury ions.

U.S. Pat. No. 4,272,342 (Fuji) states that lithographic plates to be electrochemically roughened may be of an alloy of aluminium with zinc, lead or bismuth; and that a nitric acid electrolyte for electrochemical roughening may contain zinc nitrate as a corrosion inhibitor.

U.S. Pat. Nos. 4,566,959 and 4,566,960 (Hoechst) describe electrolytes for electrochemical roughening, comprising hydrochloric acid or nitric acid together with an inorganic fluorine compound such as $SbF_6$. The aluminium metal sheet to be roughened may contain small amounts of zinc.

Where no function of an alloying component is stated, the function may be inferred as being to improve the mechanical properties of the lithographic plate. None of the references discussed in the four preceding paragraphs teaches or suggest that the added component can accelerate the electrograining (electrochemical roughening).

The present invention provides a method of electrochemically roughening an aluminium metal sheet for use as a lithographic plate support, which method comprises subjecting the sheet in an electrolyte to an alternating current treatment to roughen the surface of the sheet, the treatment being performed in the presence of an added component selected from at least one of Hg, Ga, In, Sn, Bi, Tl, Cd, Pb, Zn and Sb, said component being present, in the sheet at a concentration of 0.01–0.5% by weight and/or as a coating on the sheet and/or in combined form in solution in the electrolyte at a concentration of 0.001M to 0.1M, the concentration being effective to increase the rate of electrochemical roughening.

The examples below demonstrate the beneficial effect of Ga and Zn and other metals in reducing the time required to fully electrograin the sheet. These are members of a family of dopant metals which are more noble than aluminium (i.e. have a more positive $M/M^{n+}$ reversible potential) and are lower melting point than aluminium. Ten such superactivating dopant metals have been identified and are listed above. As described in European patent specification 326338A, aluminium sheet containing these dopant metals is more electrochemically active than pure aluminium would be under the same reaction conditions. This is believed to be because the dopant metals break down the naturally occurring protective film by localised action (pitting). It can be observed that the surface of the sheet becomes pitted on a scale of a few tens of microns, with globules or agglomerations of the dopant metals at the bottoms of the pits.

The inventors have observed that these dopant metal additions to the aluminium sheet increase the rate of electrograining. They believe this is due to the superactivating effect referred to. They believe that all known superactivators will show the same accelerating effect on the electrograining process.

The added component is preferably present at least partly in solution in the aluminium metal sheet. Such sheet may be made by providing an ingot of the required composition, hot rolling and then cold rolling to sheet of the desired thickness. The cold rolling may be interrupted by an annealing step. The concentration of the added component is 0.01–0.5 weight %, particularly 0.02–0.1 weight %, of the aluminium metal sheet. The lower ends of these ranges cover metal compositions which occasionally arise adventitiously in ordinary aluminium from commercial smelters. The present invention is limited to Al alloys to which the stated component has been deliberately added. Alternatively, the added component need not be present uniformly in the Al alloy sheet, but may be concentrated at the surface or may even be provided as a coating on the surface.

The concentration of the added component is effective to increase the rate of electrochemical roughening. In a comparison between two electrochemical roughening systems, a) with the added component present, and b) with the said component not present, the rate of electrochemical roughening is greater in a) than in b). This rate may be measured e.g. as inverse to the time taken to achieve full electrograining under given conditions of voltage and electrolyte; or as inverse to the total current (here expressed in $kCm^{-2}$) required to achieve full electrograining under given conditions. This increase in rate is preferably by at least 5% and is often by 10– 40%.

The term aluminium metal sheet is used herein to include sheets of pure aluminium and of alloys containing a major proportion of aluminium. Alloys conventionally used to make lithographic plate supports by electrochemical roughening are, after inclusion of the stated added component, suitable for use in the method of this invention. Such alloys include those of the 1000, 3000, 5000 and 6000 series of the Aluminum Association designation, e.g. the alloy 1050A.

Alternatively, the added component may be present in combined form in solution in the electrolyte. The concentration of this generally charged species in the electrolyte is from 0.001 to 0.1M.

Hg, Tl and Cd are non-preferred, on account of their toxicity.

The aqueous electrolyte used in the method of this invention can be one used in conventional electrochemical roughening processes. Electrolytes based on nitric acid are preferred, but those based on hydrochloric acid are also possible. Conventional additives to such electrolytes include boric acid with nitric acid, and acetic, tartaric, formic and other organic acids with hydrochloric acid. Electrolyte concentration is preferably in the range 1–250 g/l, preferably 5–100 g/l, and electrolyte temperature is preferably from 20°–60° C. Temperature has only a small influence on graining speed.

Microscopic examination of conventional commercial electrochemically roughened Al sheets shows the presence of pits of at least two different sizes. There are large pits of average diameter 10–20 μm; and smaller pits of average diameter 1–10 μm, generally accompanied also by pits of sub-micron size. The surface consists of larger pits with plateaus between them, both the larger pits and the plateaus being themselves pitted with smaller pits. This structure with a range of pit sizes is believed particularly suitable for lithographic sheet.

Starting with a smooth sheet, a certain amount of metal needs to be removed to provide this desired pitting structure. Assuming 100% efficiency, there is a theoretical minimum amount of electric charge needed to remove that metal. In practice, the electrochemical graining process is not 100% efficient. Conventional electrograining on a commercial scale typically requires an AC input of at least 75 kCoulombs per square meter of aluminium sheet surface.

The components added according to the present invention improve the electrograining efficiency, and hence reduce the total electric charge input required. The total charge input of the AC electrograining treatment is preferably from 35–75 $kCm^{-2}$, particularly 50–70 $kCm^{-2}$ in $HNO_3$ or HCl other electrolytes may require somewhat different charge inputs.

(It should be mentioned that two other ideas have been proposed for improving electrograining efficiency. The natural potential of the Al metal sheet may be biased in an anodic direction, but the result is an altered and coarser pitting structure. Ultrasound may be used to clean the metal surface and so accelerate electrograining, but at the cost of adding transducers to the cell; GB 1374787.)

The following examples illustrate the invention.

Using aluminium alloy AA1050A as a reference various different alloys were produced and samples were prepared in sheet form ready for processing into lithographic printing plates in accordance with the following procedure:

A 150×100×25 mm ingot was heated at 50° C./hour to 580° C., held at this temperature for six hours, cooled at a rate of 50° C./hour to 500° C. and then hot rolled to a thickness of 4.5 mm. The hot rolled plate was then cold rolled to a thickness of 2.25 mm, was batch annealed by heating at a rate of 30° C./hour 450° C., was held at this temperature for two hours, and finally was cooled at a rate of 30° C./hour to room temperature. The annealed sheet was then cold rolled from 2.25 mm to a thickness of 0.30 mm.

The base alloy contained Si, 0.06–0.08; Fe, 0.34–0.36; Ti, 0.004–0.007; balance 99.999% super purity Al. The following alloys were made.

| Alloy | Zn (%) | Ga (%) | Sn (%) |
|---|---|---|---|
| 1 | 0.100 | 0 | 0 |
| 2 | 0 | 0.100 | 0 |
| 3 | 0.026 | 0 | 0 |
| 4 | 0.058 | 0 | 0 |
| 5 | 0 | 0.025 | 0 |
| 6 | 0 | 0.049 | 0 |
| 7 | 0 | 0 | 0 |
| 8 | 0 | 0 | 0.026 |
| 9 | 0 | 0 | 0.051 |
| 10 | 0 | 0 | 0.10 |

EXAMPLE 1

Samples were grained in a laboratory twin cell system operated in the liquid contact mode. The electrolyte was 1% nitric acid. The voltage applied was 14 V AC and the spacing between each aluminium alloy sample and its graphite counter-electrode was 15 mm. This arrangement has been shown to produce surfaces similar to those produced commercially using standard 1050A lithographic quality material. The time taken to produce a fully grained surface is approximately 30 seconds and the total charge input was about 87 $kCm^{-2}$. In these experiments the applied AC had approximately equal forward and reverse components, and only the natural bias of approximately −1 V was encountered on the aluminium sample surfaces.

Samples of alloy 3, 4, 5 and 6 were tested in this cell, and were shown to be severely overgrained after 30 seconds electrograining. The experiments were repeated with 20 seconds electrograining, and the resulting surfaces were found to be fully grained and comparable to the standard sheet material after 30 seconds treatment. The total charge input during these 20 seconds electrograining treatments were in the range of 64–68 $kCm^{-2}$. The reductions in graining time are very significant.

Samples of alloys 8 and 9 were grained under the same conditions. These alloys gave suitable surfaces after 20 seconds graining during which time the total charge passed was 65 and 67 $kCm^{-2}$ respectively.

Samples of alloys 1, 2 and 10 were grained under the same conditions. These alloys also gave suitable surfaces after 20 seconds graining.

EXAMPLE 2

Alloys 1, 2 and 7 were subjected to tensile measurements to determine their bake resistance properties. The ultimate tensile strength (UTS) and the 0.2% proof stress (PS) were determined in the as rolled state and after storing at 240° C. for 10 minutes. The properties of alloys 1 and 2 were equal to or better than those of alloy 7. Thus, substantial additions of Zn or Ga enhance, rather than spoil, the mechanical properties of the alloy sheet.

EXAMPLE 3

This example shows the effect of providing the added component in the electrolyte.

Experiments were performed as described in Example 1, using the base alloy 7 not containing any Zn or Ga addition. Different additions were made to the electrolyte giving the following results:

- When the electrolyte was 1% nitric acid without addition, the time taken to produce a fully grained surface was approximately 30 seconds and the total charge input was about 87 $kCm^{-2}$.

When the electrolyte contained $In^{3+}$, at a concentration of 0.01M, the time taken to produce a fully grained surface was 20 seconds and the total charge input was 58 $kCm^{-2}$.

When the electrolyte contained 0.01M $Zn^{2+}$, the time taken to produce a fully grained surface was 20 seconds and the total charge input was 60 $kCm^{-2}$.

In each case, the surface was evenly covered with pits and was of commercial quality. This demonstrates that components added in solution in the electrolyte can also be used to reduce graining time and total charge input.

Samples of base alloy 7 were grained in a similar manner but with electrolytes containing 0.02M additions of zinc or indium ions. Both electrolytes produced suitable surface finishes in 20 seconds and used 63 and 58 $kCm^{-2}$, respectively

EXAMPLE 4

Samples were grained in the same apparatus as described in Example 1 but with an electrolyte comprising 0.6% nitric acid and 0.6% boric acid, which effects electropolishing as well as electrograining. The voltage employed was 11.5 V AC. The time taken to produce a fully grained surface is typically 150 seconds with these less aggressive graining conditions and the charge passed with alloy 7 was 111 $kCm^{-2}$. Samples of alloys 4, 6 and 9 were tested for a range of times. The times taken to produce fully grained surfaces having similar appearance and roughness to those obtained on sample 7 and commercial alloys of this AA1050A composition range were 110, 90 and 90 seconds and the charge passed were 82, 65 and 64 $kCm^{-2}$, respectively.

EXAMPLE 5

Alloys based on super purity (SP) 99.999% Al were produced in a similar manner to that described for the 1050A variants and were investigated to highlight the effect these accelerating additions can have.

| Alloy | Sb (%) |
|---|---|
| 11 | 0.01 |
| 12 | 0 |

Graining alloys 11 and 12 in a similar manner to that employed in Example 1 produced surfaces that were similar to each other in 25 and 30 seconds respectively, again showing the improved response additions at this low level can have.

EXAMPLE 6

Alloys based on AA3103 were also investigated. The sheet material was produced in a similar manner to that described for the 1050A variants but interannealing was carried out at a gauge of 0.72 mm at 320° C. for 2 hours and the final gauge attained was 0.28 mm. For these variants the main alloying elements were Si 0.7–0.09; Fe 0.52–0.57; Ti 0.008–0.010; Mn 1.08–1.12; balance super purity (SP) Al. The following alloys were made.

| Alloy | Zn | Ga (%) |
|---|---|---|
| 13 | 0 | 0 |
| 14 | 0 | 0.025 |
| 15 | 0.023 | 0 |

Graining was carried out in a similar manner to that described in Example 1. The standard alloy, 13, was not quite fully grained after 30 seconds and exhibited some streaking, which is common commercial experience with this alloy in nitric acid based electrolytes. The total charge used was 77 $kCm^{-2}$.

A sample of alloy 14 was fully grained after 25 seconds and one of alloy 15 was grained to a similar degree to the control. The charges passed were 68 and 67 $kCm^{-2}$, respectively

EXAMPLE 7

Samples of base 1050A and 3103 alloys were grained in a similar manner to that described in Example 3 but with an electrolyte containing additions of 0.01M $Zn^{2+}$, 0.01M $In^{3+}$ and 0.01M $Ga^{3+}$. The 1050A base alloy was fully grained in 20 seconds after a charge of 49 $kCm^{-2}$ had been passed and had a slightly finer surface than the standard.

The 3103 base alloy was fully grained after 25 seconds and consumed a charge density of 64 $kCm^{-2}$. The surface produced was almost free of streaking (c.f. Example 6).

EXAMPLE 8

Two alloys were used for this experiment:

i) AA1050A, 0.38 Fe, 0.08 Si, 0.01 Ti, 0.025 Ga, balance Al plus normal impurities;

ii) AA1050A, 0.38 Fe, 0.08 Si, 0.01 Ti, 0.025 Zn, balance Al plus normal impurities Samples were grained in a laboratory cell that had been shown to produce surfaces similar to those produced commercially. The electrolyte used was 1% nitric acid. The voltage applied was 7 V AC and the electrode spacing was 15 mm. On this alternating current, a direct current was superimposed. Specifically, the sample was treated for 8 seconds with a 7 V alternating current on which was superimposed a 1 V DC bias, the sample being biased in the anodic direction. Then the direct current was reversed, so that the sample was biased by 1 V in a cathodic direction, and electrochemical roughening continued for a further 8 seconds.

Both alloys were fully grained by this treatment lasting only 16 seconds. The amount of electricity passed was respectively 51 and 53 $kCm^{-2}$. The pores were relatively large and unevenly distributed.

We claim:

1. A method of electrochemically roughening an aluminium metal sheet for use as a lithographic plate support, which method comprises subjecting the sheet in an electrolyte to an alternating current treatment to roughen the surface of the sheet, the treatment having a charge input of from about 35 to about 75 $kCm^{-2}$ and being performed in the presence of an added component selected from at least one of Hg, Ga, In, Sn, Bi, Tl, Cd, Pb, Zn and Sb, said component being present, in the sheet at a concentration of 0.01–0.5% by weight and/or as a coating on the sheet and/or in combined form in solution in the electrolyte at a concentration of 0.001M to 0.1M, the concentration being effective to increase the rate of electrochemical roughening.

2. A method as claimed in claim 1, wherein the added component is present in a concentration of 0.02–0.1% wt % and at least partly in solution in the aluminium metal sheet.

3. A method as claimed in claim 1, wherein the electrolyte is based on nitric acid.

4. A method as claimed in claim 1, wherein the added component is Ga or Zn.

5. A method as claimed in claim 1, wherein the aluminium metal sheet is of AA1050A or AA31Q3.

6. In a method of electrochemically roughening an aluminium metal sheet for use as a lithographic plate support, which method comprises subjecting the sheet in an electrolyte to an alternating current treatment having a charge input of from about 35 to about 75 $kCm^{-2}$ to roughen the surface of the sheet, use of an added component selected from Hg, Ga, In, Sn, Bi, Tl, Cd, Pb, Zn and Sb to increase the rate of electrochemical roughening, said added component being present, in the sheet at a concentration of 0.01–0.5% by weight and/or in combined form in solution in the electrolyte at a concentration of 0.001M to 0.1M.

* * * * *